US011718088B2

(12) United States Patent
Claudon

(10) Patent No.: US 11,718,088 B2
(45) **Date of Patent: *Aug. 8, 2023**

(54) DOCTOR BLADE, INKING ARRANGEMENT AND USE OF DOCTOR BLADE IN FLEXOGRAPHIC PRINTING

(71) Applicant: BTG ECLÉPENS S.A., Eclépens (CH)

(72) Inventor: Alexandre Claudon, Cheseaux-Noréaz (CH)

(73) Assignee: BTG ECLEPENS S.A., Eclépens (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/773,437

(22) PCT Filed: Nov. 4, 2016

(86) PCT No.: PCT/EP2016/076697
§ 371 (c)(1),
(2) Date: May 3, 2018

(87) PCT Pub. No.: WO2017/077053
PCT Pub. Date: May 11, 2017

(65) Prior Publication Data

US 2018/0319153 A1 Nov. 8, 2018

(30) Foreign Application Priority Data

Nov. 4, 2015 (EP) ..... 15192936

(51) Int. Cl.
*B41F 9/10* (2006.01)
*B41F 31/04* (2006.01)
(Continued)

(52) U.S. Cl.
CPC ..... *B41F 31/04* (2013.01); *B41F 9/063* (2013.01); *B41F 9/10* (2013.01); *B41F 9/1072* (2013.01);
(Continued)

(58) Field of Classification Search
CPC .. B41F 31/04; B41F 9/063; B41F 9/10; B41F 9/1072; B41F 31/20; B41N 10/005
See application file for complete search history.

(56) References Cited

U.S. PATENT DOCUMENTS 6,155,167 A 12/2000 Meyer
6,431,066 B1 * 8/2002 Perez ..... B41F 31/027 101/157
(Continued)

FOREIGN PATENT DOCUMENTS

DE 3302317 A1 8/1983
DE 4024514 A1 2/1992
(Continued)

OTHER PUBLICATIONS

PraxAir datasheet, dated Dec. 9, 2009 (Year: 2009).*
International Search Report for International Application No. PCT/EP2016/076697, dated Feb. 21, 2017, 3 pages.

*Primary Examiner* — Yaovi M Ameh
*Assistant Examiner* — Quang X Nguyen
(74) *Attorney, Agent, or Firm* — Brake Hughes Bellermann LLP

(57) ABSTRACT

A doctor blade (5, 7) for contact with an anilox roller (15) comprises a flat, elongate base element having a thickness of less than about 0.3 mm, which, along a longitudinal region of the doctor blade adapted for contact with said anilox roller, is provided with a coating (43). The coating comprises a metal matrix and at least about 65% by weight of one or more ceramic(s). The coating comprises 0 to 65% by weight of chromium carbide. An inking arrangement comprises an anilox roller and a doctor blade. A doctor blade is used in flexographic printing.

20 Claims, 2 Drawing Sheets

(51) Int. Cl.

| | |
|---|---|
| ***B41N 10/00*** | (2006.01) |
| ***D21G 3/00*** | (2006.01) |
| ***B41F 31/20*** | (2006.01) |
| ***B41F 9/06*** | (2006.01) |

(52) U.S. Cl.
CPC ..... *B41F 31/20* (2013.01); *B41N 10/005* (2013.01); *D21G 3/005* (2013.01)

(56) References Cited

U.S. PATENT DOCUMENTS

| | | | | |
|---|---|---|---|---|
| 2007/0017160 | A1* | 1/2007 | Caldwell | B24D 3/00 51/298 |
| 2008/0023168 | A1* | 1/2008 | Conn | B31F 1/145 15/256.51 |
| 2008/0096037 | A1 | 4/2008 | Daxelmuller et al. | |
| 2008/0127495 | A1* | 6/2008 | Fantoni | B05C 11/045 30/169 |
| 2009/0053423 | A1* | 2/2009 | Freti | B05C 11/04 427/451 |
| 2013/0014656 | A1 | 1/2013 | Brudermann et al. | |
| 2013/0071647 | A1* | 3/2013 | Mayr | D21G 3/005 428/325 |
| 2014/0000467 | A1 | 1/2014 | Lunnerfjord | |

FOREIGN PATENT DOCUMENTS

| | | | |
|---|---|---|---|
| DE | 102008001721 | A1 | 11/2009 |
| EP | 0061093 | A1 | 9/1982 |
| EP | 2423345 | A1 | 2/2012 |
| JP | 2004167902 | A | 6/2004 |
| WO | 01/60620 | A1 | 8/2001 |
| WO | 2007/003332 | A1 | 1/2007 |

* cited by examiner

DOCTOR BLADE, INKING ARRANGEMENT AND USE OF DOCTOR BLADE IN FLEXOGRAPHIC PRINTING

CROSS REFERENCE TO RELATED APPLICATION

This application is a 35 U.S.C. § 371 National Phase Entry Application from PCT/EP2016/076697, filed on Nov. 4, 2016, and designating the U.S., which claims priority under 35 U.S.C. § 119 to European Patent Application No. 15192936.1, filed on Nov. 4, 2016, the disclosures of which are incorporated herein in their entireties by reference.

TECHNICAL FIELD

The present application relates to a doctor blade for contact with an anilox roller, to an inking arrangement comprising an anilox roller and a doctor blade for contact with the anilox roller, and to the use of a doctor blade in flexographic printing.

BACKGROUND ART

In the art of flexographic printing the amount of ink is volumetrically metered by the use of an engraved roller, commonly called an anilox roller. This roller is usually constituted by a metal cylinder onto which a ceramic coating has been applied. The ceramics are normally applied by a thermal spray process. For the purpose of volumetric metering of the ink, the ceramic surface is laser engraved in order to create uniform cells for carrying and evenly transferring the ink to a flexible relief plate. The ink is subsequently transferred from the relief plate onto a substrate (e.g. polymer film, paper or carton board) to be printed.

The fineness of the engraving, which is directly linked to the printing quality, is often expressed as the lineation, i.e. as the number of lines or cells per unit length (e.g. as the number of lines or cells per cm, l/cm) and/or as a cell transfer volume (e.g. in $cm^3/m^2$). As flexographic printing technology has evolved, engraving accuracy has in the past years moved from a lineation of about 80 l/cm towards 500 l/cm and from a cell transfer volume of about 20 $cm^3/m^2$ towards 2 $cm^3/m^2$. The term "high definition flexo printing" often refers to the use of anilox rollers with even finer engraving, such as anilox rollers with an lineation of from 600 to 650 l/cm, and a low quantity of ink transferred, corresponding to a cell diameter of around 15 to 17 μm as engraved on the surface of the anilox roller.

In a typical inking arrangement, two doctor blades define an ink chamber in co-operation with an anilox roller and a blade holder unit. As the anilox roller rotates, the entrance blade, also called the positive blade, seals the chamber, while the exit blade, also called the negative blade, removes excess of ink from the roller surface. The contact properties between the blades and the surface of the anilox roller are important for ensuring an optimized transfer of the ink and the final printing quality.

WO 01/60620 discloses a doctor blade for direct contact with an inking roller provided with a ceramic coating or sleeve. The doctor blade comprises a strip of metallic carrier material, said strip, along one edge section thereof facing the inking roller, being provided with a ceramic coating. The ceramic coating has a wear-resistance lower than that of said sleeve and higher than that of said strip.

US 2013/0014656 discloses a doctor blade for scraping printing ink from a surface of a printing plate. The working edge region of the blade is coated with at least a first coating based on a nickel-phosphorus alloy comprising hard material particles. A second coating based on nickel may be arranged on the first coating. The second coating may comprise hard material particles.

Some current doctor blades are less appropriate to correctly doctor increasingly delicate anilox roller surfaces or to match new challenging demands for printing quality. Other current doctor blades are appropriate to doctor such surfaces but do not meet requirements for longevity and machine productivity. For these and other reasons there is a need for development of doctor blades for use in flexographic printing.

SUMMARY OF THE INVENTION

It is a main object of the present invention to provide a doctor blade for use in flexographic printing, allowing for excellent printing quality while at the same time allowing for outstanding operational productivity. It is thus an object of the present invention to provide a doctor blade having a surface intended for contact with an anilox roller, which surface is indisposed for developing surface defects resulting from the manufacturing or the use of the blade. It is another object of the present invention to provide such a doctor blade having a surface intended for contact with the anilox roller, which surface is indisposed for affecting negatively the ink metering and transferring function of the anilox roller. It is a further object of the present invention to provide such a doctor blade having a surface intended for contact with the anilox roller providing for an extended lifetime of the blade.

These objects as well as other objects of the invention, which should be apparent to a person skilled in the art after having studied the description below, are in one aspect of the invention accomplished by a doctor blade for contact with an anilox roller, the doctor blade comprising a flat, elongate base element having a thickness of less than about 0.3 mm, which, along a longitudinal region of the doctor blade adapted for contact with said anilox roller, is provided with a coating, wherein the coating comprises a metal matrix and at least about 65% by weight of one or more ceramic(s) and wherein the coating comprises 0 to 65% by weight of chromium carbide.

It was surprisingly found that a doctor blade having a surface coating intended for contact with the anilox roller comprising a metal matrix and at least about 65% by weight of one or more ceramic(s), wherein the coating comprises 0 to 65% by weight of chromium carbide, meets high quality requirements of flexographic printing in that the contact surface, when wearing during its use, has the ability to maintain a good sealing effect and a stable doctoring effect for a long time. It was thus of a surprise to see that the contradictory requirement between a defect-free smooth contact (expectedly good if the fraction of the ductile metal phase is high) and a high wear resistance (expectedly good if the fraction of the reinforcing ceramic is high) meets high quality requirements of flexographc printing at a high ceramic content, despite the high hardness and increased brittleness expected from the ceramic. In this context it was also surprisingly found that, despite of the high hardness, such ceramic based materials display material compatibility with the anilox roller. The doctor blade may accordingly be a doctor blade for flexographic printing.

The understanding of the coating comprising 0 to 65% by weight of chromium carbide is that the coating may comprise no CrC or up to 65% by weight of CrC.

As an alternative, the coating may comprise a metal matrix and at least 70% by volume of the one or more ceramic(s). The volume content of the ceramic may be determined by methods known to persons skilled in the art, such as by image analysis of the microstructure of the coating.

The one or more ceramic(s) may be one or more carbide ceramic(s), nitride ceramic(s) and/or oxide ceramic(s), the carbide ceramic(s) preferably being one or more metal carbide(s), more preferably one or more of chromium carbide, tungsten carbide and silicon carbide, most preferably one or both of chromium carbide and tungsten carbide.

The one or more ceramic(s) may be one or more carbide ceramic(s) among which chromium carbide is present, preferably one or more metal carbide(s) among which chromium carbide is present, more preferably chromium carbide and none, one or both of tungsten carbide and silicon carbide.

The coating may comprise 0 to 60% by weight of chromium carbide, preferably 0 to 30% by weigh of chromium carbide, more preferably the coating may be essentially free from chromium carbide.

Chromium carbide may be present in the coating in an amount of up to 65% by weight, preferably from 0.1 to 65% by weight, more preferably from 10 to 60% by weight, most preferably from 10 to 30 or from 30 to 60% by weight.

The coating may comprise 0 to 85% by weight, preferably 0 to 65% by weight, more preferably 0 to 55% by weight, of tungsten carbide.

Tungsten carbide may be present in the coating in an amount of up to 90% by weight, preferably from 0.1 to 90% by weight, more preferably from 25 to 85% by weight, most preferably from 25 to 55 or from 55 to 85% by weight.

Chromium carbide and tungsten carbide may be present in the coating in an amount of 10 to 60% by weight of CrC and 25 to 85% by weight of WC, more preferably 10 to 30% by weight of CrC and 55 to 85% by weight of WC, or 30 to 60% by weight of CrC and 25 to 55% by weight of WC.

Silicon carbide may be present in the coating in an amount of up to 90% by weight, preferably from 0.1 to 90% by weight, more preferably from 25 to 85% by weight, most preferably from 25 to 55 or from 55 to 85% by weight.

The coating may comprise at least about 5% by weight, preferably at least 10% by weight, of the metal matrix. As the metal phase acts as a binder in the composite system of ceramic and metal, there is a metal content level, depending on specific printing configuration conditions, below which the mechanical properties will decrease.

The metal matrix may comprise nickel, cobalt or chromium, or a combination thereof. Suitable combinations are nickel and chromium, or cobalt and chromium. The metal matrix preferably comprises nickel and chromium, more preferably nickel and chromium in a Ni:Cr weight ratio of about 1:1 to 9:1, most preferably in a Ni:Cr weight ratio of about 3:1 to 6:1. In general, the metal matrix may comprise one or more metals.

The coating may comprise about 70 to 90% by weight, preferably about 75 to 85% by weight, of the ceramic. It is especially preferred that the coating comprises about 70 to 90% by weight, or 75 to 85% by weight, of chromium carbide.

The composition, such as the composition in % by weight, of the coating may be determined by methods known to persons skilled in the art, such as by energy-dispersive X-ray spectroscopy (EDX or EDS), Auger electron spectroscopy (AES), scanning Auger microprobe (SAM), secondary ion mass spectrometry (SIMS), X-ray photoelectron spectroscopy (XPS) or electrothermal atomization-atomic absorption spectrometry (ETA-AAS).

The ceramic is typically present in the coating as particles, preferably as particles of which a majority has a particle size of about 2 to 10 μm. The particle size may be determined by image analysis of a microscopic image of the coating. The coating may have a Vickers hardness in the range of about 800 to 1300 Hv. The doctor blade may have been provided with the coating by thermal spraying, optionally after a surface treatment of and/or application of a binding layer on the base element. A preferred method for the thermal spraying is HVOF (high velocity oxygen fuel) spraying. The raw material for the thermal spraying may be a powder comprising both metal and ceramic. The powder may comprise ceramic particles and metal, preferably so that the ceramic particles appear as filler and the metal appears as binder.

The coating may have a thickness of about 15 to 60 μm, preferably of about 30 to 40 μm. The coating may have a width of about 1 to 6 mm, preferably of about 2 to 5 mm, more preferably of about 3 to 4 mm.

The base element may be a steel strip. Normally, carbon steel or stainless steel is used. The steel may be hardened and tempered. The steel strip forming the base element may be constituted by a steel band.

The base element may have a thickness of less than about 0.3 mm, preferably of about 0.1 to 0.25 mm, more preferably of about 0.15 to 0.25 mm. The base element may have a width of about 10 to 60 mm, preferably of about 25 to 35 mm.

The doctor blade may have a rounded cross-section along the longitudinal region of the doctor blade adapted for contact with said anilox roller. The rounded cross section may be present at least on the doctor blade as manufactured or, in other words, be present on the doctor blade at least before it has been in use against the anilox roller. In flexographic printing the negative doctor blade works in opposition against the anilox roller, creating a challenging wear situation involving high stress at the blade tip and a risk of micro-vibration. Typically with hard and brittle materials (e.g. materials characterized by a Vickers hardness of 800 Hv and above), such wear situation may create micro-defects at the blade tip. It was found that printing defects caused by such micro-defects at the blade tip were reduced when the coating was provided with a rounding. Furthermore, prior art doctor blades for flexography need to be bent in order to operate (i.e. doctor) properly. As a consequence, the working surface is the front face of the blade. For this reason, such blades are provided with a defined front angle (i.e. a tip bevel) to better adapt to the surface of the anilox roller. With a rounded tip design, such tip bevel is no longer necessary but the doctor blade may work on its contact angle, on the rounding.

The rounded cross-section may have a diameter of about 10 to 50 μm, preferably of about 20 to 40 μm, more preferably of about 25 to 35 μm. The diameter of the rounding may be determined by methods known to persons skilled in the art, such as by measuring, in a microscopic image of a cross-section of the doctor blade, the diameter of a circular arc fitted to the rounding. It is preferred that the centre of the diameter of the rounded cross-section is located substantially at the bisectrix between the front face and the outer adjacent face (i.e. outside the ink chamber) of the doctor blade.

Said anilox roller may have a surface layer of a ceramic material, such as a ceramic coating, shell or sleeve. The ceramic material may be based on $Cr_2O_3$. The ceramic material may thus comprise $Cr_2O_3$ as a main component.

Normally the ceramic material consists of $Cr_2O_3$ but for any unavoidable impurities or foreign elements, e.g. so that it comprises ≥97% by weight of $Cr_2O_3$. The surface layer of a ceramic material may be applied to the anilox roller by thermal spraying. The surface layer of a ceramic material may comprise ink cells, typically formed by laser engraving. The Vickers hardness of this ceramic coating, shell or sleeve may be in the range of about 1200 to 1400 Hv.

Said anilox roller may have a lineation of at least about 80 l/cm, preferably of at least about 500, 600 or 650 l/cm. Such preferred lineations correspond to cell diameters of less than about 20 μm, preferably of less than about 17 μm, more preferably of less than about 15 μm.

Defects at the blade surface may result from the blade manufacturing or be created during the blade usage. It has been found that for obtaining a satisfactory printing result the size of such defect on the blade surface in the contact area should preferably not exceed the cell size of the engraved pattern. At the longitudinal region of the doctor blade adapted for contact with the anilox roller, the size of any surface defect may be no more than about 20 μm, preferably no more than about 17 μm, more preferably no more than about 15 μm. The size of such a surface defect may be determined by methods known to persons skilled in the art, such as by measuring, in a microscopic image of the longitudinal region of the doctor blade adapted for contact with an anilox roller, the diameter of a circle inscribing the defect. It is preferred that no surface defect extends, in the machine direction, all across the longitudinal region of the doctor blade adapted for contact with the anilox roller.

The above-mentioned objects are in another aspect of the invention accomplished by an inking arrangement comprising an anilox roller and a doctor blade for contact with the anilox roller, the doctor blade comprising a flat, elongate base element, which, along a longitudinal region of the doctor blade adapted for contact with said anilox roller, is provided with a coating, wherein the coating comprises a metal matrix and at least about 65% by weight of one or more ceramic(s) and wherein the coating comprises 0 to 65% by weight of chromium carbide.

The inking arrangement may be further defined as laid out above for the doctor blade and for the anilox roller.

The doctor blade may be arranged in a trailing position or in a butting position in relation to the anilox roller. The doctor blade may be arranged in a butting position in relation to the anilox roller, allowing it to work in opposition against the anilox roller. The inking arrangement may comprise two doctor blades, preferably defining an inking chamber together with the anilox roller and, optionally, a blade holder unit. One blade may then be placed in a trailing position and the other blade in a butting position in relation to the anilox roller. The blade angle, i.e. the angle between the doctor blade and the tangent of the anilox roller, of the doctor blade in the butting position and/or of the doctor blade in the trailing position is typically about 35 to 40°. The respective blade angle is typically set by the configuration of the inking arrangement, i.e. the blade angle is fixed during printing. Trailing and butting positions correspond respectively to positive blade mode and negative blade mode. A doctor blade doctoring a rotogravure printing cylinder does so in a trailing position and at a blade angle of typically about 40 to 60°, with a possibility to adjust the angle during printing. As compared to a doctor blade doctoring a rotogravure printing cylinder, a doctor blade doctoring a flexographic anilox roller thus does so at a narrower, fixed, angle and, as concerns a doctor blade in a butting position, works in opposition. In comparison with the conditions for doctoring a rotogravure printing cylinder, the conditions for doctoring an anilox roller thus creates a challenging wear situation (cf. above), in which the contact conditions for optimal doctoring are different as compared to rotogravure. Principles and experiences from doctoring in rotogravure can thus not be applied to flexographic printing.

The above-mentioned objects are in further aspect of the invention accomplished by use of a doctor blade comprising a flat, elongate base element, which, along a longitudinal region of the doctor blade, is provided with a coating, wherein the coating comprises a metal matrix and at least about 65% by weight of one or more ceramic(s) and wherein the coating comprises 0 to 65% by weight of chromium carbide, in flexographic printing, preferably for contact with an anilox roller.

The use may be further defined as laid out above for the doctor blade, for the anilox roller and/or for the inking arrangement.

BRIEF DESCRIPTION OF THE DRAWINGS

The invention will be described in the following with reference to the appended drawings.

DETAILED DESCRIPTION

Figures 3A, 3B, 3C, 3D:
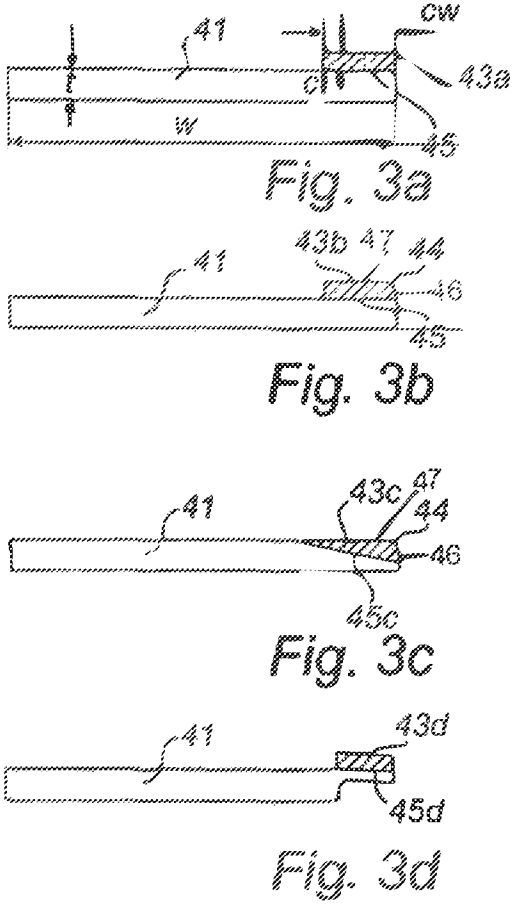
FIGS. 3*a* to 3*d* are diagrammatic side views of four different embodiments of doctor blades.

The flexographic printer 1 shown diagrammatically in FIG. 1 in a side view is provided with an inking blade unit 3 with a blade holder 9 carrying two blades 5, 7 to be further described in connection with FIG. 2. Furthermore, the printer 1 has an anilox roller 15 constituted by a steel drum covered with a ceramic sleeve or shell. The inking blade unit 3 is associated with a printing ink container 27, an ink feeding conduit 29 containing an ink feeding pump 31 for the transfer of printing ink from an ink supply 37 to the inking blade unit 3. Furthermore, a return conduit 35 is provided for the return of excessive printing ink to the container 27. The printer 1 is furthermore provided with a printing plate cylinder 21, carrying printing plates 19, and a pressure roller 23. A substrate 25, such as a paper web or a polymer film, for printing travels in the nip between cylinder 21 and roller 23 in the direction indicated in FIG. 1.

Figure 2:
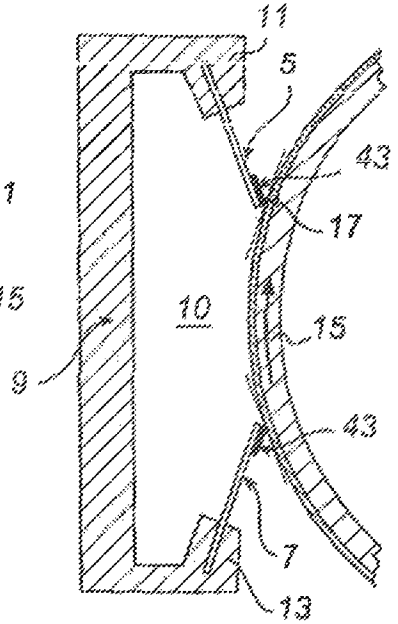
FIG. 2 shows in a side view the arrangement contained within the dashed line square of FIG. 1.
Figure 1:
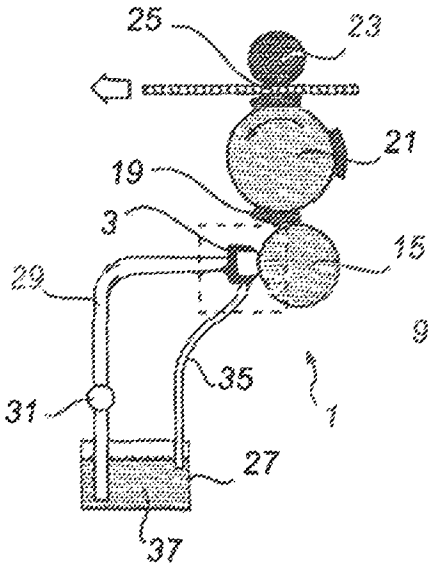
FIG. 1 shows diagrammatically in a side view a machine for flexographic printing.

In FIG. 2 there is shown by an enlarged side view the arrangement around the inking blade unit 3 as contained within the dashed line square of FIG. 1. The blade holder 9 is provided with two carrier flanges 11, 13, each carrying a blade 5, 7 arranged in butting and trailing positions, respectively, vis-a-vis the anilox roller 15. The anilox roller 15 is comprised of a steel cylinder 15 covered by a ceramic shell or sleeve 17, comprising $Cr_2O_3$ as a main component. As is seen in FIG. 2, blade 7 has a sealing function, whereas blade 5 has a wiping function removing excess printing ink from the surface of the ceramic sleeve 17. The inking blade unit 3 defines an inking chamber 10 together with the anilox roller 15 with blades 5, 7 in engagement on the surface of the anilox roller 15. Blades 5, 7 are each provided with a coating 43, comprising a metal matrix and at least 65 wt % of a ceramic, facing the surface of the anilox roller 15.

FIG. 3*a* shows in a side view a steel strip 41 having an edge region 45 coated with a coating 43*a* comprising a metal matrix and at least 65 wt % of a ceramic. FIG. 3*a* furthermore illustrates schematically the thickness t and the width w of the base element as referred to herein. FIG. 3*a* also illustrates schematically the thickness ct and width cw of the coating as referred to herein.

FIG. 3*b* shows a similar arrangement but with the coating 43*b* being provided with a rounding 44 at the longitudinal region of the doctor blade adapted for contact with the anilox roller 15.

FIG. 3*c* shows an embodiment with the steel strip 41 being provided with a bevel 45*c* on the edge region, the coating 43*c* having a corresponding triangular configuration. The coating 43*c* has as well as a rounding 44 at the longitudinal region of the doctor blade adapted for contact with the anilox roller 15.

In FIGS. 3*b* and 3*c*, the doctor blade comprises a front face 46, an adjacent face 47, and a rounded cross-section 44 along the longitudinal region of the doctor blade adapted for contact with the anilox roller; the rounded cross-section has a diameter comprising a center and the center of the diameter is located substantially at a bisectrix between the front face and the adjacent face of the doctor blade.

FIG. 3*d* shows an embodiment of the lamella type, wherein the strip edge region 45*d* has a recess opposite to the coating 43*d*. The coating 43*d* is shown with a square shape, but may alternatively have a rounded shape, at the longitudinal region of the doctor blade adapted for contact with the anilox roller 15.

EXAMPLES

The invention will now be further illustrated by examples disclosing experimental procedures, data and images illustrating the inventive concept. Throughout the examples the symbol wt % is used to denote % by weight. It should, however, be noted that the present invention is in no respect restricted to the conditions and materials disclosed in the examples. Rather, the invention is restricted only as reflected by the scope of the claims.

Example 1. Material Behavior

Pin-on-Disc tribometer tests according to ASTM G 99 were conducted to analyze the abrasion wear and friction behavior of a variety of materials listed in the tables below.

A fixed pin coated by thermal spraying with the respective materials listed in the tables was loaded against rotating discs of cast iron. Cast iron was selected to represent an appropriate counter surface in order to accelerate the wear process to be evaluated. The wear of the pin coating was calculated as the mass loss divided by the sliding distance and the load, and was reported as the pin wear coefficient. The wear of discs was measured as the depth of the wear track, and was reported as the disc wear depth. The pin and disc temperatures were measured. The friction force was calculated as end of test average.

| Material (oxide ceramics, comparative examples) | 60 wt % $Al_2O_3$ 40 wt % $ZrO_2$ | 97 wt % $Al_2O_3$ 3 wt % $TiO_2$ | 100 wt % $Cr_2O_3$ |
|---|---|---|---|
| Pin wear coefficient ($g\ m^{-1}\ N^{-1}$) | 8.64E−10 | 1.57E−08 | 1.25E−08 |
| Disc wear depth (μm) | 14 | 243 | 154 |
| Pin temperature (° C.) | 90 | 90 | 100 |
| Disc temperature (° C.) | 154 | 154 | 130 |
| Friction force (N) | 80 | 36 | 70 |

-continued

| Material (carbide particles in metal matrix) | 80 wt % CrC 17 wt % Ni 3 wt % Cr | 86 wt % WC 10 wt % Co 4 wt % Cr | 73 wt % WC 20 wt % CrC 7 wt % Ni |
|---|---|---|---|
| Pin wear coefficient ($g\ m^{-1}\ N^{-1}$) | 4.32E−10 | 1.20E−09 | 1.67E−09 |
| Disc wear depth (μm) | 22 | 26 | 20 |
| Pin temperature (° C.) | 72 | 140 | 100 |
| Disc temperature (° C.) | 132 | 152 | 150 |
| Friction force (N) | 44 | 94 | 60 |

Example 2. Surface Quality of the Blade and Material Compatibility

Doctor blades were manufactured by providing steel strips with coatings comprising CrC in a NiCr matrix by thermal spraying. CrC—Ni—Cr 80/17/3 wt % powders having different CrC particle size (about 5 μm and about 3.5 μm, particle size distribution average, Fisher Sub Sieve Sizer (FSSS) standard) were used as raw materials for the thermal spraying. Doctor blades having CrC—Ni—Cr coatings of different Vickers hardness (1050 Hv and 900 Hv) were obtained. The doctor blades were tested during 138 hours of operation on a full-scale flexographic printer with the following conditions and parameters.

Machine: Windmoeller & Hoelscher—Miraflex CM—8 units
Speed: 300 m/min
Anilox roller (lineation): 300 l/cm
Cell transfer volume: 3.5 $cm^3/m^2$
Pressure: 1.8 bar
Chambered doctor blade: Yes (negative position)
Work: Process
Ink: Cyan (solvent-based)
Viscosity: 19-20" DIN cup 4
Substrate: polymer films (BOPP, PET, OPA)

No printing defects were detected. The best result in this configuration was achieved with a CrC carbide size of around 5 microns (particle size distribution average—FSSS standard). It was noted that higher hardness of the coating rendered an increased longevity of the blade.

It is expected that depending on the mechanical stress and physical constraints applied in the printing configuration, other materials could potentially perform better. Such stress and constraints are dependent on many parameters, such as blade contact pressure, counter-face (anilox roller) rotation speed, ink type and amount (lubricant effect). Examples of other CrC based materials could comprise a CrC content of at least 65 wt % and a metal matrix content below 35 wt %.

Example 3. Blade Tip Design

Doctor blades were manufactured by providing steel strips with coatings comprising CrC in a NiCr matrix by thermal spraying. A CrC—Ni—Cr 80/17/3 wt % powder was used as raw material for the thermal spraying. The coatings formed were ground to obtain top and front surfaces meeting at an angle of about 90°, and subsequently polished to obtain a rounded shape of 30 μm diameter at the edge of the doctor blade intended for contact with the anilox roller. The doctor blades were tested on a full-scale flexographic printer with the following conditions and parameters.

Machine: Fischer & Krecke—Flexpress 16S—8 units
Speed: 250 m/min
Anilox roller (lineation): Harper 420 l/cm and Inoflex 420 l/cm
Cell transfer volume: 3.4 $cm^3/m^2$
Pressure: 3.4-3.5 bar
Chambered doctor blade: Yes (negative position)
Work: Process
Ink: Cyan (solvent-based Siegwerk NC-402)
Viscosity: 21-22" DIN cup 4
Substrate: polymer film (LD-PE (white))

The main objective of this test was to investigate the influence of the blade tip design on the doctoring effectiveness and quality in order to optimize the ink dynamics management. A good printing result, at least as good as for a reference lamella type steel blade having a front angle for adaptation to the anilox roller, was achieved with the rounded edge carbide based doctor blades.

It is expected that depending on the fluid dynamics in the application, other similar blade tip designs could potentially perform better. Such hydrodynamic properties are dependent on many parameters, such as blade contact pressure, counter-face (anilox roller) rotation speed, ink type and amount (lubricant effect). Examples of similar blade tip designs involving a rounding could have a diameter in the range of about 10 to 50 μm.

Example 4. Scanning Electron Microscope (SEM) Images

Figure 4A:
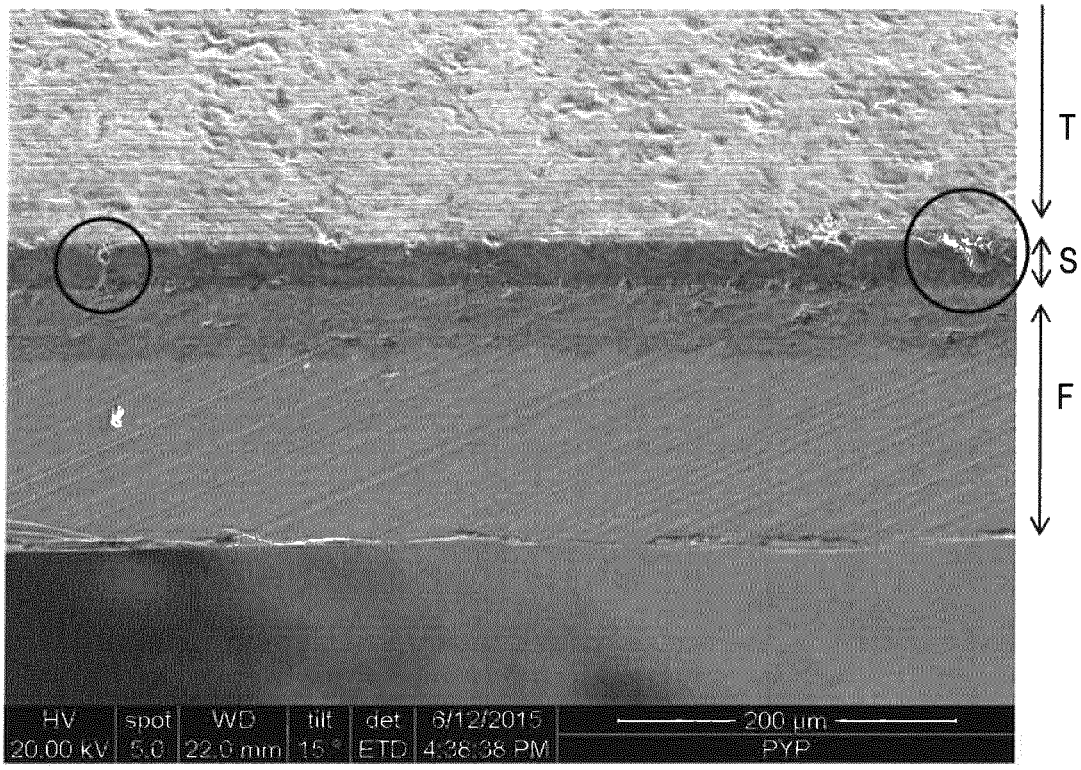
FIGS. 4*a* and 4*b* are scanning electron microscope (SEM) images of the tip of doctor blades that have been used against an anilox roller.
Figure 4B:
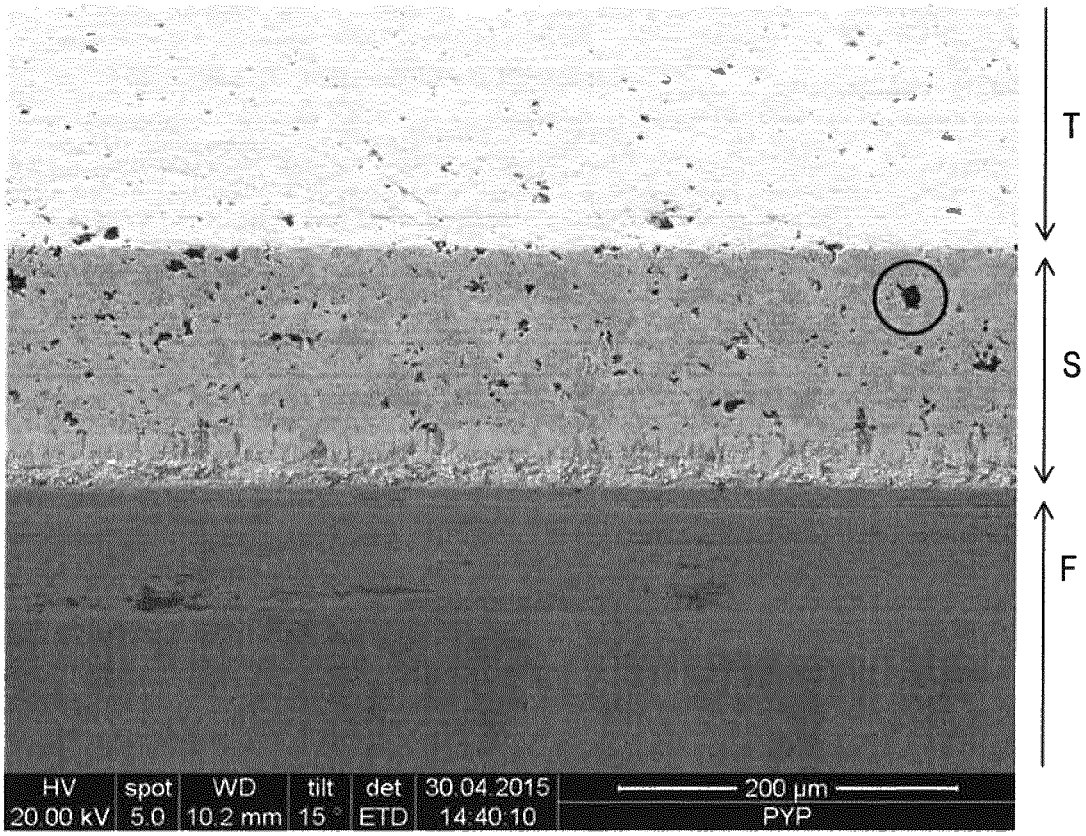

FIGS. 4*a* and 4*b* are SEM images of the tip of doctor blades that have been used against an anilox roller. In these figures, the blade top (outside the ink chamber) is denoted by T, the sliding surface (in contact with the anilox roller surface) is denoted by S, and the blade front (inside the ink chamber) is denoted by F.

FIG. 4*a* is an image of the tip of a doctor blade having an $Al_2O_3$—$ZrO_2$ coating comprising 60 wt % $Al_2O_3$ and 40 wt % $ZrO_2$. Encircled on the right is a local defect having a size of about 40 μm. Encircled on the left is a smaller defect extending all through the sliding surface, leading to a potential continuous leak of ink. These kinds of defects are common in such ceramic material. Especially defects of the type on the right may be even larger. As a remark, this doctor blade has a narrow sliding surface because it was prematurely removed from a printing unit due to a quality issue.

FIG. 4*b* is an image of the tip of a doctor blade from Example 2 (CrC—Ni—Cr 80/17/3 wt %, CrC particle size about 5 μm (FSSS)). Encircled is a local defect having a size of no more than about 15 μm. This defect is the largest found in the analyses of worn blades from the full-scale tests of Example 2. The sliding surface is much wider than in FIG. 4*a*, indicating that this doctor blade has been in operation in the printing unit for a long time without any quality issue.

Example 5. Printing Tests

Doctor blades were manufactured by providing steel strips with coatings comprising CrC and WC in a NiCrCo matrix by thermal spraying. A CrC—WC-metal 45/37/18 wt % powder, the 18 wt % of metal being Ni—Cr—Co 12/3/3 wt %, was used as raw material for the thermal spraying. The CrC particle size was about 5 μm and the WC particle size was around 2.5 μm (particle size distribution average, Fischer Sub Sieve Sizer (FSSS) standard). These doctor blades were compared to the blades of Example 2 in operation on a full-scale flexogaphic printer with the following conditions and parameters.

Machine: Comexi Fi 160-8 units
Speed: 250 m/min
Anilox roller (lineation): Apex (480 l/cm for process ink and 200 l/cm for white ink) and majority Sandon i-Pro (480 l/cm for process ink and 200 l/cm for white ink)
Cell transfer volume: 3.5 $cm^3/m^2$ for process ink and 10 $cm^3/m^2$ for white ink
Pressure: 3 bar
Chambered doctor blade: Yes (negative position)
Work: White and process
Ink: solvent-based white and solvent-based magenta
Viscosity: 20" DIN cup 4
Substrate: transparent foil (PE)

It is known that white ink have a higher abrasiveness than process inks (cyan-magenta-yellow), except black. The potential abrasiveness could be 5 to 10 times higher in the case of white inks.

CrC based coatings brought the highest printing quality. In a more aggressive environment in terms of wear (influenced by the ink type, anilox rotation speed, blade contact pressure, ink amount etc.), CrC—WC based coatings were found to bring an acceptable printing quality and a good productivity.

First Itemized List of Embodiments

1. A doctor blade for contact with an anilox roller, the doctor blade comprising a flat, elongate base element having a thickness of less than about 0.3 mm, which, along a longitudinal region of the doctor blade adapted for contact with said anilox roller, is provided with a coating, wherein the coating comprises a metal matrix and at least about 65% by weight of one or more ceramic(s) and wherein the coating comprises 0 to 65% by weight of chromium carbide.

2. A doctor blade according to item 1, the one or more ceramic(s) being one or more carbide ceramic(s), nitride ceramic(s) and/or oxide ceramic(s), the carbide ceramic(s) preferably being one or more metal carbide(s), more preferably one or more of chromium carbide, tungsten carbide and silicon carbide, most preferably one or both of chromium carbide and tungsten carbide.

3. A doctor blade according to item 1, the one or more ceramic(s) being one or more carbide ceramic(s) among which chromium carbide is present, preferably one or more metal carbide(s) among which chromium carbide is present, more preferably chromium carbide and none, one or both of tungsten carbide and silicon carbide.

4. A doctor blade according to any one of the preceding items, wherein the coating comprises 0 to 60% by weight of chromium carbide, preferably 0 to 30% by weigh of chromium carbide, more preferably wherein the coating is essentially free from chromium carbide.

5. A doctor blade according to any one of the preceding items, wherein chromium carbide is present in the coating in an amount of up to 65% by weight, preferably from 0.1 to 65% by weight, more preferably from 10 to 60% by weight, most preferably from 10 to 30 or from 30 to 60% by weight.

6. A doctor blade according to any one of the preceding items, wherein the coating comprises 0 to 85% by weight, preferably 0 to 65% by weight, more preferably 0 to 55% by weight, of tungsten carbide.

7. A doctor blade according to any one of the preceding items, wherein tungsten carbide is present in the coating in an amount of up to 90% by weight, preferably from 0.1 to 90% by weight, more preferably from 25 to 85% by weight, most preferably from 25 to 55 or from 55 to 85% by weight.

8. A doctor blade according to any one of the preceding items, wherein chromium carbide and tungsten carbide are present in the coating in an amount of 10 to 60% by weight of CrC and 25 to 85% by weight of WC, more preferably 10 to 30% by weight of CrC and 55 to 85% by weight of WC, or 30 to 60% by weight of CrC and 25 to 55% by weight of WC.

9. A doctor blade according to any one of the preceding items, wherein silicon carbide is present in the coating in an amount of up to 90% by weight, preferably from 0.1 to 90% by weight, more preferably from 25 to 85% by weight, most preferably from 25 to 55 or from 55 to 85% by weight.

10. A doctor blade according to any one of the preceding items, wherein the coating comprises at least about 5% by weight, preferably at least about 10% by weight, of the metal matrix.

11. A doctor blade according to any one of the preceding items, wherein the metal matrix comprises nickel, cobalt or chromium, or a combination thereof, preferably nickel and chromium.

12. A doctor blade according to any one of the preceding items, wherein the coating comprises about 70 to 90% by weight, preferably about 75 to 85% by weight, of the one or more ceramic(s).

13. A doctor blade according to any one of the preceding items, wherein the coating has a thickness of about 15 to 60 μm, preferably of about 30 to 40 μm.

14. A doctor blade according to any one of the preceding items, wherein the base element is a steel strip.

15. A doctor blade according to any one of the preceding items, wherein the base element has a thickness of about 0.1 to 0.25 mm, preferably of about 0.15 to 0.25 mm.

16. A doctor blade according to any one of the preceding items, having a rounded cross-section along the longitudinal region of the doctor blade adapted for contact with said anilox roller.

17. A doctor blade according to item 16, wherein the rounded cross-section has a diameter of about 10 to 50 μm, preferably of about 20 to 40 μm, more preferably of about 25 to 35 μm.

18. A doctor blade according to any one of the preceding items, wherein said anilox roller has a surface layer of a ceramic material, such as a ceramic coating, shell or sleeve, the ceramic material preferably comprising $Cr_2O_3$ as a main component.

19. An inking arrangement comprising an anilox roller and a doctor blade for contact with the anilox roller, the doctor blade comprising a flat, elongate base element, which, along a longitudinal region of the doctor blade adapted for contact with said anilox roller, is provided with a coating, wherein the coating comprises a metal matrix and at least about 65% by weight of one or more ceramic(s) and wherein the coating comprises 0 to 65% by weight of chromium carbide.

20. An inking arrangement according to item 19, further defined as in any one of items 2 to 14 or items 16 to 18.

21. An inking arrangement according to item 19 or 20, wherein the base element has a thickness of less than about 0.3 mm, preferably about 0.1 to 0.25 mm, more preferably about 0.15 to 0.25 mm.

22. Use of a doctor blade comprising a flat, elongate base element, which, along a longitudinal region of the doctor blade, is provided with a coating, wherein the coating comprises a metal matrix and at least about 65% by weight of one or more ceramic(s) and wherein the coating comprises 0 to 65% by weight of chromium carbide, in flexographic printing, preferably for contact with an anilox roller.

23. Use according to item 22, further defined as in any one of items 1 to 21.

Second Itemized List of Embodiments

1. A doctor blade for contact with an anilox roller, the doctor blade comprising a flat, elongate base element, which, along a longitudinal region of the doctor blade adapted for contact with said anilox roller, is provided with a coating, the coating comprising a metal matrix and at least about 65% by weight of a ceramic, such as a carbide ceramic, a nitride ceramic or an oxide ceramic.

2. A doctor blade according to item 1, wherein the ceramic is a metal carbide, preferably chromium carbide.

3. A doctor blade according to item 1 or 2, wherein the coating comprises at least about 5% by weight, preferably at least about 10% by weight, of the metal matrix.

4. A doctor blade according to any one of the preceding items, wherein the metal matrix comprises nickel, cobalt or chromium, or a combination thereof, preferably nickel and chromium.

5. A doctor blade according to any one of the preceding items, wherein the coating comprises about 70 to 90% by weight, preferably about 75 to 85% by weight, of the ceramic.

6. A doctor blade according to any one of the preceding items, wherein the coating has a thickness of about 15 to 60 μm, preferably of about 30 to 40 μm.

7. A doctor blade according to any one of the preceding items, wherein the base element is a steel strip.

8. A doctor blade according to any one of the preceding items, wherein the base element has a thickness of less than about 0.3 mm, preferably of about 0.1 to 0.25 mm, more preferably of about 0.15 to 0.25 mm.

9. A doctor blade according to any one of the preceding items, having a rounded cross-section along the longitudinal region of the doctor blade adapted for contact with said anilox roller.

10. A doctor blade according to item 9, wherein the rounded cross-section has a diameter of about 10 to 50 μm, preferably of about 20 to 40 μm, more preferably of about 25 to 35 μm.

11. A doctor blade according to any one of the preceding items, wherein said anilox roller has a surface layer of a ceramic material, such as a ceramic coating, shell or sleeve, the ceramic material preferably comprising $Cr_2O_3$ as a main component.

12. An inking arrangement comprising an anilox roller and a doctor blade for contact with the anilox roller, the doctor blade comprising a flat, elongate base element, which, along a longitudinal region of the doctor blade adapted for contact with said anilox roller, is provided with a coating, the coating comprising a metal matrix and at least about 65% by weight of a ceramic, such as a carbide ceramic, a nitride ceramic or an oxide ceramic.

13. An inking arrangement according to item 12, further defined as in any one of items 2 to 11.

14. Use of a doctor blade comprising a flat, elongate base element, which, along a longitudinal region of the doctor blade, is provided with a coating comprising a metal matrix and at least about 65% by weight of a ceramic, such as a carbide ceramic, a nitride ceramic or an oxide ceramic, in flexographic printing, preferably for contact with an anilox roller.

15. Use according to item 14, further defined as in any one of items 1 to 13.

The invention claimed is:

1. An inking arrangement comprising:

an anilox roller; and a doctor blade for contact with the anilox roller, the doctor blade comprising a flat, elongate base element, which, along a longitudinal region of the doctor blade adapted for contact with the anilox roller, is provided with a coating, the coating comprising a metal matrix and at least 65% by weight of at least two ceramics, the at least two ceramics including:

chromium carbide in an amount of 10% to 65% by weight of the coating; and tungsten carbide in an amount of 25% to 85% by weight of the coating, wherein the doctor blade further comprises a front face, an adjacent face, and a rounded cross-section along the longitudinal region of the doctor blade adapted for contact with the anilox roller, wherein the rounded cross-section has a diameter comprising a center, and wherein the center of the diameter is located substantially at a bisectrix between the front face and the adjacent face of the doctor blade.

2. The inking arrangement according to claim 1, wherein the coating has a thickness of 15 to 60 μm.

3. The inking arrangement according to claim 1, wherein the coating comprises at least 5% by weight of the metal matrix.

4. The inking arrangement according to claim 1, wherein the metal matrix comprises at least one of nickel, cobalt or chromium.

5. The inking arrangement according to claim 1, wherein the coating comprises 70 to 90% by weight of the at least two ceramics.

6. The inking arrangement according to claim 1, wherein the coating has a thickness of 30 to 40 μm.

7. The inking arrangement according to claim 1, wherein the flat, elongate base element is a steel strip.

8. The inking arrangement according to claim 1, wherein the flat, elongate base element has a thickness of 0.1 to 0.25 mm.

9. The inking arrangement according to claim 1, wherein the rounded cross-section has a diameter of 10 to 50 μm.

10. The inking arrangement according to claim 1, wherein the anilox roller has a surface layer of a ceramic material.

11. The inking arrangement according to claim 10, wherein the ceramic material includes chromium oxide as a main component.

12. The inking arrangement according to claim 1, wherein the flat, elongate base element has a thickness of less than 0.3 mm.

13. The inking arrangement according to claim 1, wherein the coating is provided by high velocity oxygen fuel spraying.

14. A method in flexographic printing, comprising contacting a doctor blade with an anilox roller, the doctor blade comprising a flat, elongate base element, which, along a longitudinal region of the doctor blade, is provided with a coating comprising a metal matrix and at least 65% by weight of at least two ceramics, the at least two ceramics including:

chromium carbide in an amount of 10% to 65% by weight of the coating; and tungsten carbide in an amount of 25% to 85% by weight of the coating, wherein the doctor blade further comprises a front face, an adjacent face, and a rounded cross-section along the longitudinal region of the doctor blade adapted for contact with the anilox roller, wherein the rounded cross-section has a diameter comprising a center, and wherein the center of the diameter is located substantially at a bisectrix between the front face and the adjacent face of the doctor blade.

15. The method according to claim 14, wherein the coating has a thickness of 15 to 60 μm.

16. The method according to claim 14, wherein the coating has a thickness of 30 to 40 μm.

17. The method according to claim 14, wherein the coating is provided by high velocity oxygen fuel spraying.

18. The method according to claim 14, wherein a surface of the anilox roller includes a ceramic material having chromium oxide as a main component.

19. The method according to claim 14, further comprising determining that a respective size of all surface defects at the longitudinal region is less than 20 μm.

20. The method according to claim 19, wherein determining the respective size of all surface defects is performed by microscopic imaging.

* * * * *